US006328495B1

(12) United States Patent
Gueret

(10) Patent No.: US 6,328,495 B1
(45) Date of Patent: Dec. 11, 2001

(54) DEVICE FOR PACKAGING AND APPLYING A SUBSTANCE, THE DEVICE HAVING A WIPER MEMBER WITH A SLOT

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/550,207

(22) Filed: Apr. 17, 2000

(30) Foreign Application Priority Data

Apr. 23, 1999 (FR) ..... 99 05169

(51) Int. Cl.[7] ..... A46B 11/00
(52) U.S. Cl. ..... 401/122; 401/121
(58) Field of Search ..... 401/122, 121, 401/118, 119, 126, 129, 130

(56) References Cited

U.S. PATENT DOCUMENTS

| | | | | |
|---|---|---|---|---|
| 3,763,870 | * | 10/1973 | Montgomery et al. | 401/122 |
| 5,137,387 | | 8/1992 | Byrd et al. . | |
| 6,010,265 | * | 1/2000 | Bouix | 401/121 |

FOREIGN PATENT DOCUMENTS

| | | |
|---|---|---|
| 17 57 096 | 1/1971 | (DE) . |
| 0 761 123 A1 | 3/1997 | (EP) . |
| 452 640 | 8/1936 | (GB) . |
| 683 932 | 12/1952 | (GB) . |
| WO 91/01097 A1 | 2/1991 | (WO) . |
| WO 96/04816 A1 | 2/1996 | (WO) . |
| WO 96/32033 A1 | 10/1996 | (WO) . |

* cited by examiner

*Primary Examiner*—David J. Walczak
(74) *Attorney, Agent, or Firm*—Oliff & Berridge, PLC

(57) ABSTRACT

A device for packaging and applying a substance, in particular a cosmetic, the device comprising a receptacle for containing said substance, an applicator having an applicator element of elongate cross-section, and a wiper member for wiping the applicator element when the applicator is extracted from the receptacle, wherein the wiper member has a slot whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn.

70 Claims, 5 Drawing Sheets

DEVICE FOR PACKAGING AND APPLYING A SUBSTANCE, THE DEVICE HAVING A WIPER MEMBER WITH A SLOT

The present invention relates to a device for packaging and applying a substance, in particular a cosmetic.

The invention relates more particularly to a packaging and applicator device comprising a receptacle for containing the substance and an applicator comprising an applicator element, the receptacle being provided with a wiper member for wiping the applicator element when the applicator is extracted from the receptacle at the time of use.

BACKGROUND OF THE INVENTION

Numerous packaging and applicator devices of that type are known.

Application NO 91/01097 discloses a device comprising a receptacle and an applicator of circular cross-section that is constituted by a brush. Such a device has a wiper member constituted by a split membrane which is provided with a central orifice whose section corresponds substantially to that of the applicator. In particular because of the presence of the above-mentioned orifice, the end of the applicator element cannot be wiped in satisfactory manner.

British patent 452 640 discloses a device having a receptacle provided with a split wiper member designed to wipe a comb inserted through a slot of the receptacle. Nothing in such a device prevents the comb from reaching the ends of the slot of the wiper member while the comb is being withdrawn.

European patent application EP-A-0 761 123 discloses a device having an applicator element of elongate cross-section. Such a device does not enable the end of the applicator element to be wiped in completely satisfactory manner over its entire length.

There exists a need to improve the quality with which the applicator element is wiped when its cross-section is of elongate shape, since the quality of the resulting makeup depends to a large extent on the quality of the wiping.

OBJECTS AND SUMMARY OF THE INVENTION

In the novel packaging and applicator device of the invention, firstly the wiper member has a slot whose edges are substantially touching at rest in the absence of the applicator, and secondly the device has a guide member for guiding the applicator while it is being withdrawn from the receptacle so as to keep the applicator element away from the axial ends of said slot while it is passing through the wiper member when the applicator is withdrawn.

In a preferred implementation of the invention, the guide member is organized to keep the applicator element far enough away from the axial ends of the slot to ensure that the edges thereof in the vicinity of said axial ends remain substantially touching while the applicator element is passing through.

By means of the invention, it is possible to wipe the applicator element in particularly satisfactory manner, particularly when the element is substantially flat, such as a brush, a comb, or a body covered in flock, with the plane of the element extending substantially parallel to the slot of the wiper member.

The applicator element may have bristles or teeth extending substantially on the axis of the applicator. In particular, the applicator element may be constituted by a comb having teeth extending substantially on the axis of the applicator, the bases of the teeth preferably being disposed along a line that is outwardly convex.

The wiper member is preferably organized in such a manner that the slot opens more easily while the applicator is being inserted into the receptacle than while it is being withdrawn therefrom.

This makes it possible to reduce the risk of the applicator element being damaged when the applicator is reinserted, while nevertheless maintaining satisfactory wiping of the applicator element while the applicator is being withdrawn.

In a particular embodiment, the receptacle has a body, and the wiper member has a resilient membrane that is clamped between a wall of the body of the receptacle extending parallel to the axis of the applicator, and an insert that is fixed on the body of the receptacle.

The said insert advantageously has a skirt at its top portion for co-operating in leakproof manner with the applicator when the applicator is in place on the receptacle, and on its bottom portion it has a guide part that converges towards the inside of the receptacle.

This guide part can be constituted, for example, by a sloping wall connected at its top end to a wall of the insert against which said membrane is clamped.

In a particular embodiment, the guide member is constituted by the neck of the receptacle and the axial ends of the slot are situated outside the smallest inside section of the neck when the device is observed on the axis of the receptacle.

The neck may be conical so as to enable the applicator to be tilted relative to the axis of the receptacle.

Still in a particular embodiment, the applicator can have a flat rod provided with the applicator element at one end.

The guide member can be organized in such a manner that the sides of the rod are prevented from coming into contact with the ends of the slot.

Advantageously, the applicator rod is provided at its other end with a handle element which also constitutes a cap for closing the receptacle.

In a particular embodiment, the neck has an oblong inside section whose shortest longitudinal dimension is only slightly greater than the width of the flat rod of the applicator.

Advantageously, the length of the slot is greater than or equal to 1.2 times the largest transverse dimension of the applicator element.

In a particular embodiment, the wiper member has a membrane made of an elastomer material.

The membrane advantageously comprises at least one preferred deformation zone facilitating opening of the slot as the applicator passes through.

In a particular embodiment, the above-mentioned preferred deformation zone is made by means of at least one zone of reduced thickness, e.g. in the form of one or more grooves formed in the outside and/or inside face of said membrane, around the above-mentioned slot.

In a particular embodiment, the slot is extended at its axial ends by cutouts for the purpose of conferring greater mobility to its longitudinal edges. These cutouts advantageously form an angle with the longitudinal edges of the slot.

Preferably, the membrane is fixed on a wall of the receptacle in such a manner that the longitudinal edges of the slot can pivot towards the inside of the receptacle, going away from said wall, while the applicator is being reinserted, and come to bear against said wall while the applicator is being withdrawn. In this way, the edges of the slot bear more strongly against the applicator element while the applicator is being withdrawn than while it is being reinserted into the receptacle, which is advantageous, as explained above.

The membrane can be fixed, for example, on an insertion cone of the receptacle for the purpose of facilitating insertion of the applicator into the receptacle.

In a particular embodiment, the receptacle has a body and a cover designed to be fixed on the body, the cover carrying the guide member and the wiper member.

The shape of the applicator is preferably chosen in such a manner as to facilitate insertion thereof through the wiper member.

The wiper member can be fixed on the guide member.

The wiper member can close the receptacle in leakproof manner when the applicator is removed therefrom.

The wiper member can press in substantially leakproof manner against the applicator when the applicator is in place in the receptacle.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
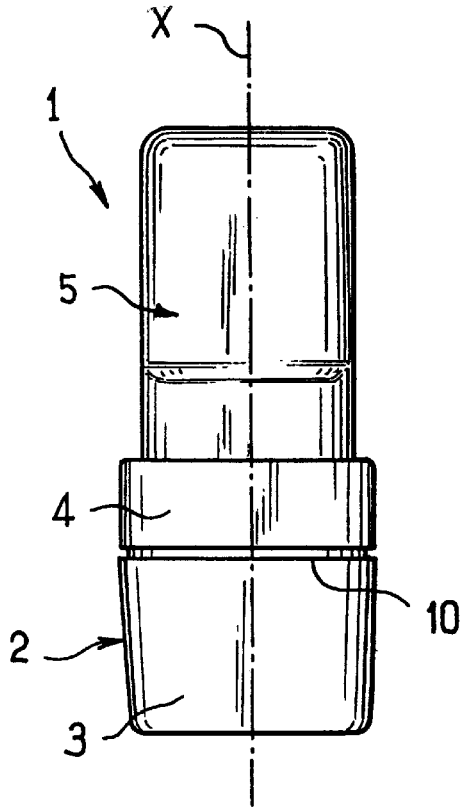
FIG. 1 is a diagrammatic front elevation view of a device constituting an embodiment of the invention.
Figure 2:
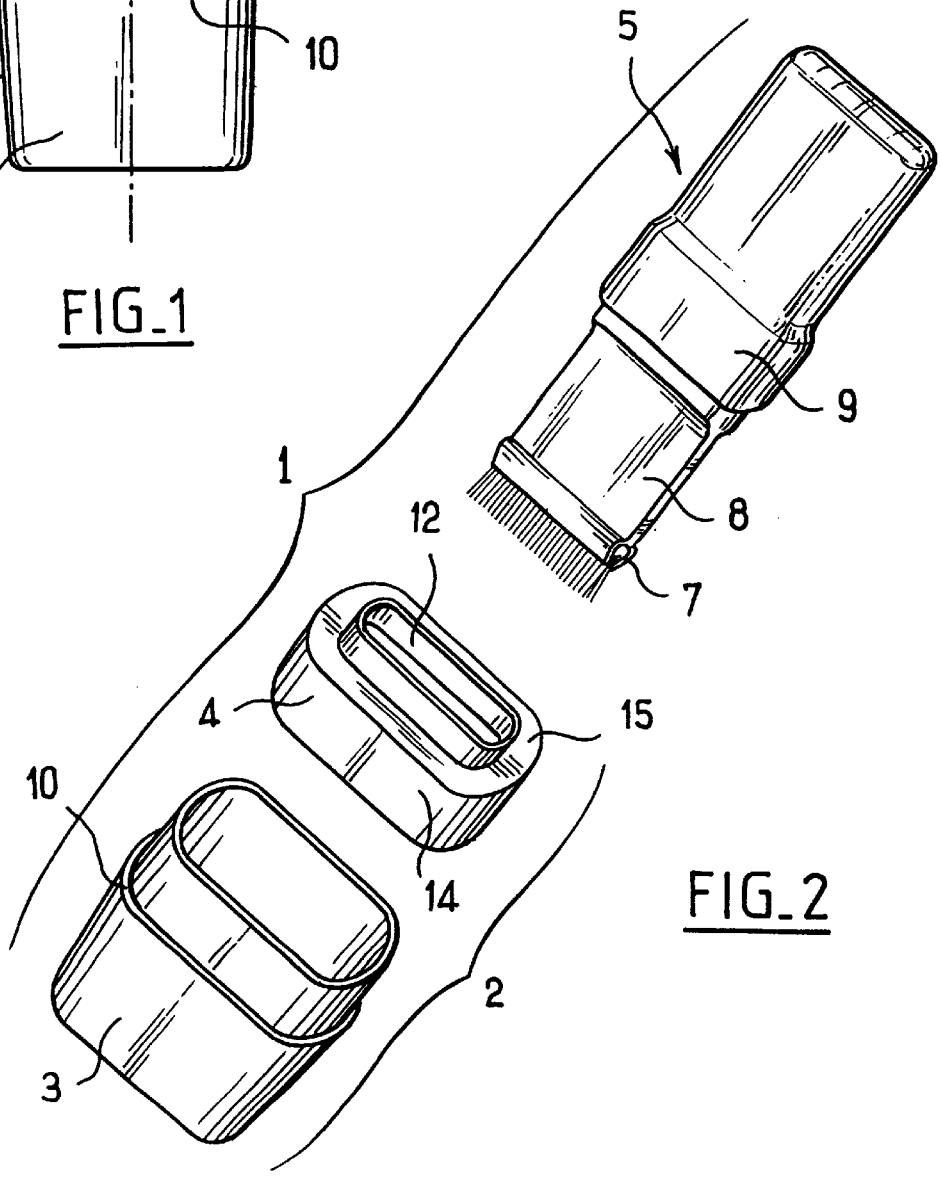
FIG. 2 is a diagrammatic perspective view of the FIG. 1 device, the cover being separated from the body of the receptacle.
Figure 3:
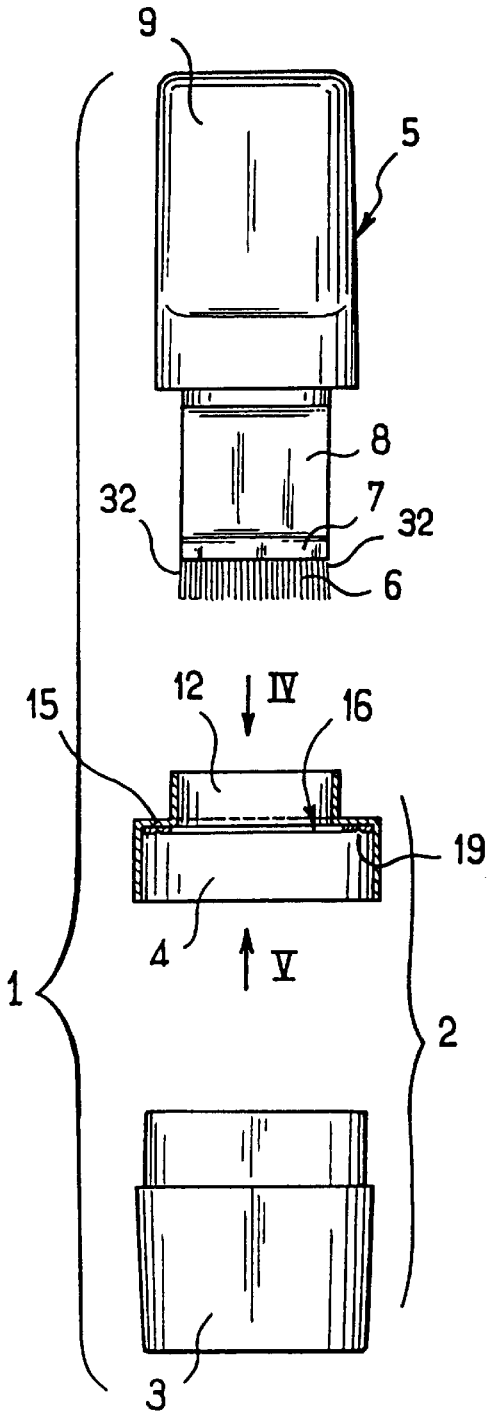
FIG. 3 is a front elevation view of the FIG. 1 device, the cover being shown in axial section and separated from the body of the receptacle, the applicator being shown outside the receptacle.

The packaging and applicator device 1 shown in FIGS. 1 to 3 comprises a receptacle 2 of axis X, having a body 3 provided at its top portion with a cover 4, and with an applicator 5.

The applicator 5 comprises an applicator element 6, for example including a brush, a foam, a flock-covered body, a comb, hairs or teeth, situated at the bottom end 7 of a thin flat rod 8 which is provided at its top end with a handle 9 that also constitutes a closure cap for the receptacle 2.

The applicator may have a sealing element for closing the receptacle in leakproof manner.

In the example described, the rod 8 is 1 mm thick and 23 mm wide.

The receptacle 2 is designed to contain any substance in liquid, semisolid, or powder form, in particular a cosmetic such as mascara.

In the example described, the body 3 and the cover 4 are made by molding a plastics material.

The body 3 has an outer shoulder 10 and the cover 4 has a skirt 14 shaped to engage on the top portion of the body 3, as shown in FIG. 1.

In the example described, the device 1 is symmetrical about the axis X.

At its top portion, the cover 4 has a neck 12 of oblong cross-section, which neck is connected to the skirt 14 via an annular transverse wall 15.

In the embodiment described, there is a wiper member which is constituted by a membrane 16 fitted to the bottom face of the transverse wall 15 to wipe the applicator element 6 as it leaves the receptacle 2.

Figure 4:
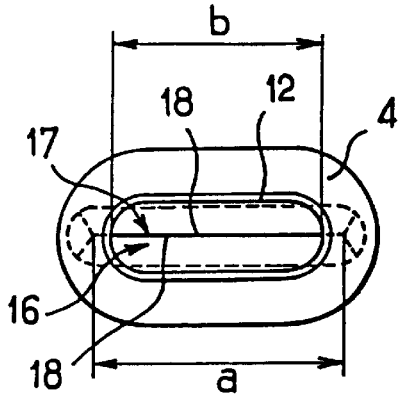
FIG. 4 is a view from above seen looking along arrow IV in FIG. 3.
Figure 5:
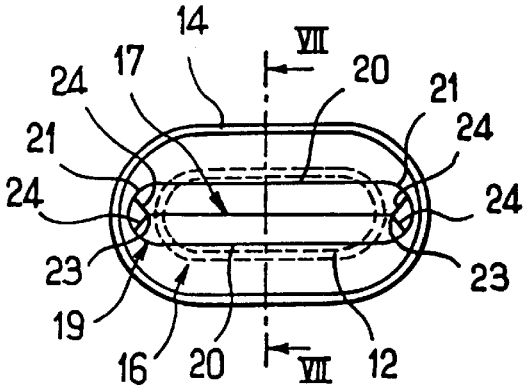
FIG. 5 is a view from below seen looking along arrow V of FIG. 3.

As can be seen more particularly in FIGS. 4 and 5, the membrane 16 has a slot 17 passing through it with longitudinal edges 18 that are rectilinear and that are substantially touching at rest when the applicator is not engaged in the receptacle.

The length of the slot 17 is greater than the greatest dimension b of the inside section of the neck 12, as can be seen in FIG. 4, and is preferably at least 20% greater.

The membrane 16 has a groove 19 formed in its bottom face, the groove 19 having two rectilinear portions 20 parallel to the longitudinal edges 18 and two circularly arcuate portions 21 interconnecting said rectilinear portions 20.

The membrane 16 is fixed at its periphery to the transverse wall 15 outside the groove 19 by any suitable means, for example by adhesive or by local welding.

The membrane 16 could also be organized in such a manner as to be fixed by snap-fastening or by clamping, being held sandwiched between two elements of the receptacle.

The slot 17 is extended on either side of its axial ends 23 by cutouts 24, each of which forms an angle with the longitudinal edges 18.

These cutouts 24 can be of various shapes, for example they can be V-shaped as shown, with branches that diverge going away from the slot 17.

The cutouts 24 could also be V-shaped with branches that diverge going towards the axis X, or they could extend perpendicularly to the longitudinal edges 18.

Figure 8:
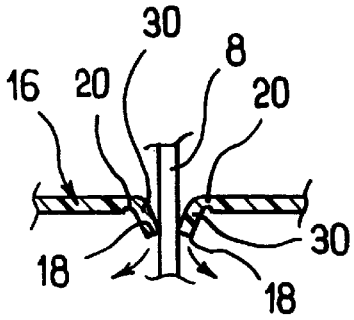
FIG. 8 shows the spacing between the longitudinal edges of the slot while the applicator is passing therethrough.

The portions 30 of the membrane 16 respectively adjacent to the longitudinal edges 18 and situated between the cutouts 24 behave like flaps when the applicator is reinserted, pivoting, as shown in FIG. 8, towards the inside of the receptacle about the rectilinear portions 20 of the groove 19, which portions then form hinges.

Figure 6A:
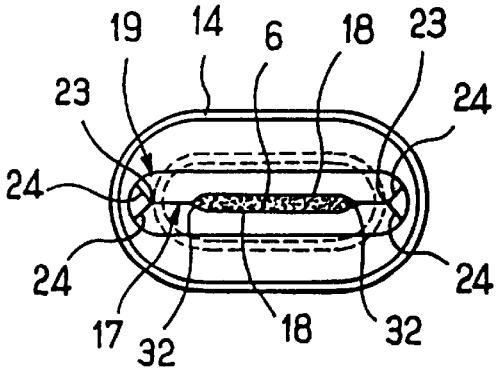
FIG. 6A is a view from below showing the applicator element while it is passing through the wiper member.
Figure 6B:
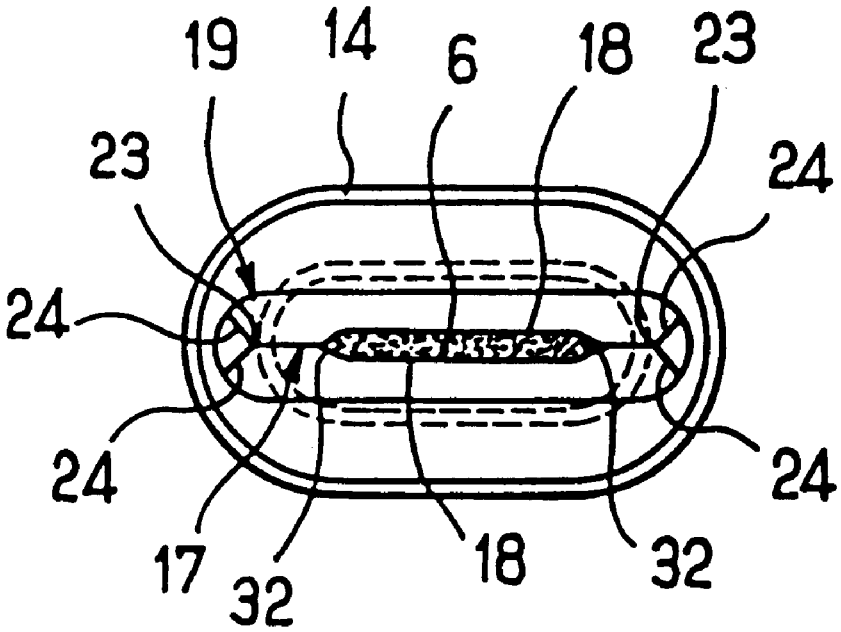
FIGS. 6B and 6C are views from below showing the applicator element while it is passing through the wiper member, the applicator element being constituted by a foam and by a flock-covered body, respectively.
Figure 6C:
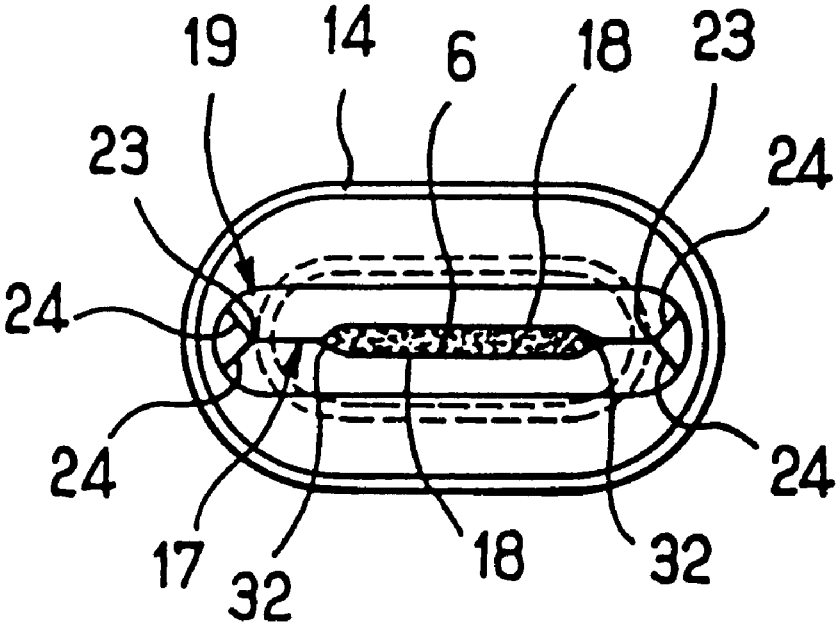
Figure 7:
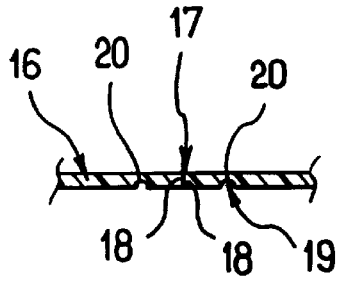
FIG. 7 is a section on section plane VII—VII of FIG. 5.

When the applicator 5 is withdrawn from the receptacle 2, the inside surface of the neck 12 can guide the flat rod 8 during its displacement and can keep the applicator element 6 away from the axial ends 23 of the slot 17 by a distance which is sufficient to ensure that the edges of the slot 17 in the vicinity of its axial ends 23 remain touching, as shown in FIGS. 6A to 6C.

In this way, the slot 17 is not fully opened while the applicator element 6 is passing through, and this is favorable to obtaining high quality wiping of the applicator element, and in particular of its side portions 32.

When the applicator is a comb, e.g. made by molding a thermoplastic material, the slot 17 allows substance to remain between the teeth of the comb, with said substance being held by capillarity.

In the example described, the flaps 30 can pivot freely downwards while the applicator is being reinserted, which is advantageous since that prevents the applicator element 6 from being damaged, as might otherwise happen, for example if excessive axial stress were to be exerted on the applicator element while it is being reinserted into the applicator.

In contrast, the flaps 30 are impeded in their outward pivoting movement while the applicator is being withdrawn by the transverse wall 15 of the cover 4.

More precisely, the flaps 30 have their longitudinal ends that come to bear against the transverse wall 15 so that only the central portions of the flaps 30 can deform outwards while the applicator element 6 is passing through during withdrawal of the applicator.

Thus, the longitudinal edges 18 of the slot bear more strongly against the applicator element 6 while the applicator is being withdrawn from the receptacle than while it is being inserted therein.

Figure 12:
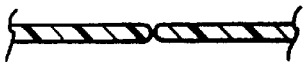
FIG. 12 shows another variant embodiment of the wiper member.

In the above-described example, the longitudinal edges 18 of the slot 17 are straight, but in a variant, as shown in FIG. 12, they could be rounded, and the membrane 16 need not have a groove 19, as likewise shown in the same figure.

Figure 10:
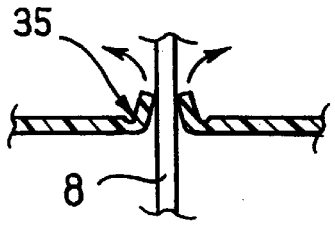
FIG. 10 shows the spacing of the longitudinal edges of the slot of the wiper member shown in FIG. 9, while the applicator is passing therethrough.
Figure 9:
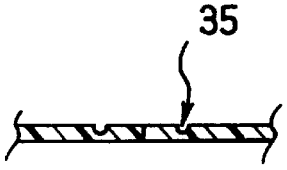
FIG. 9 shows a variant embodiment of the wiper member.

In the variant embodiment of FIGS. 9 and 10, a zone of weakness is formed in the membrane 16 by means of a groove 35 which extends around the same path as the above-described groove 19, but in the top face of the membrane 16.

Figure 11:
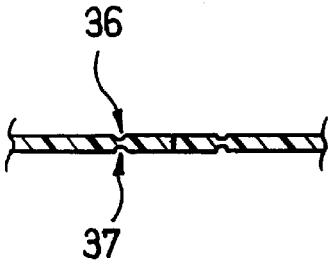
FIG. 11 shows a variant embodiment of the wiper member.

In the variant embodiment shown in FIG. 11, a zone of weakness is obtained by making grooves 36 and 37 in both the top and the bottom faces of the membrane 16, these grooves defining between them a zone of reduced thickness following the same path as the above-described grooves 19 or 35.

It will be observed that depending on the way in which the zones of weakness are made and on the locations chosen therefor, it is possible to ensure that the slot opens more or less easily during insertion of the applicator into the receptacle and also during extraction therefrom.

Figure 14:
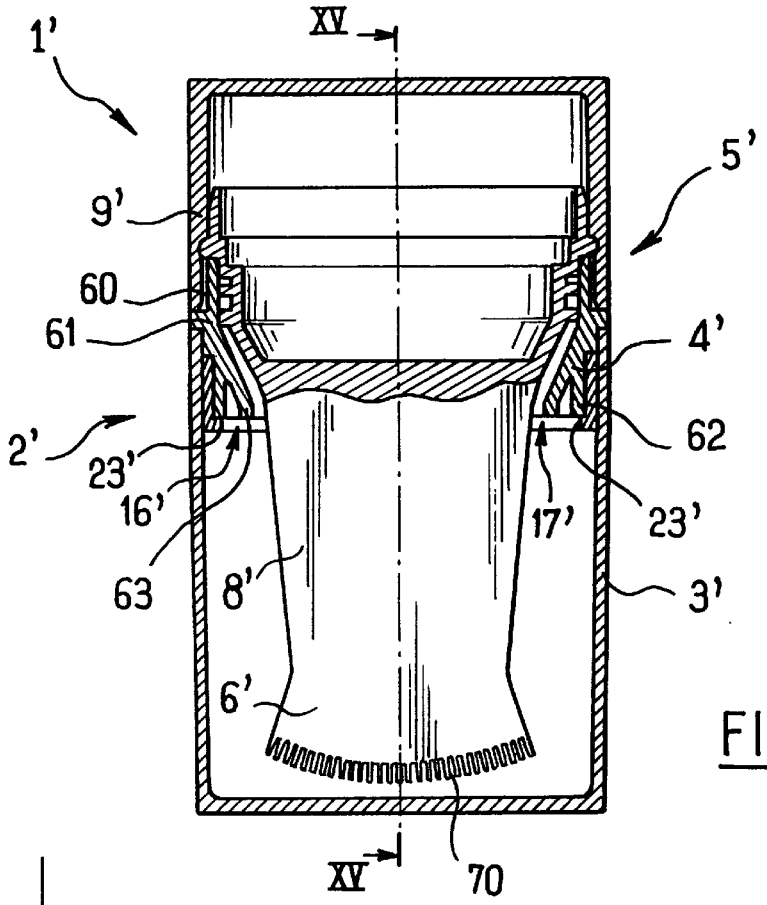
FIG. 14 is a diagrammatic axial section of a device constituting a variant implementation of the invention.
Figure 15:
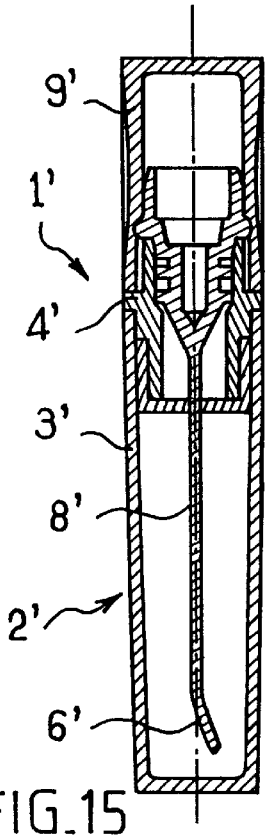
FIG. 15 is a section on XV—XV of FIG. 14.
Figure 16:
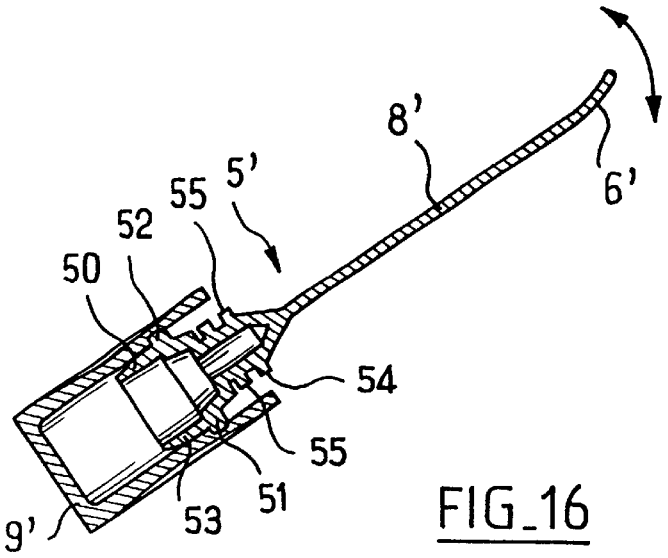
FIG. 16 shows the applicator of the FIG. 14 device in isolation.

FIGS. 14 to 16 show a device constituting a variant implementation of the invention.

This device 1' has a receptacle 2' comprising a body 3' which is open at its top end, and an insert 4' engaged in the opening of the body 3'.

The device 1' also has an applicator 5' comprising an applicator element 6', a flat rod 8', and a handle portion 9'.

The receptacle 2' has a wiper member 16' which is constituted in this example by a membrane having a slot 17' passing therethrough parallel to the section plane of FIG. 14, and extending over the entire width of the body 3' of the receptacle 2'.

The membrane 16' can deform in elastic manner.

The rod 8' is flat, its plane being parallel to the slot 17'.

As can be seen more particularly in FIG. 15, the applicator 5' is formed by assembling two elements together, specifically a first element comprising the rod 8', the applicator element 6', and a fixing portion 50 which is made integrally by molding a plastics material to the end of the rod 8' remote from the applicator 6', and also by a cap which constitutes the handle portion 9'.

The fixing portion 50 serves to assemble the rod 8' with the handle portion 9'.

As can be seen in FIG. 16, the inside surface of the handle has a groove 51 that receives a projection 52 on the fixing portion 50, which fixing portion also has an assembly skirt 53 that is pressed against the inside surface of the handle portion 9'.

Between the rod 8' and the fixing portion 50, the applicator 5' has a sealing portion 54 presenting a plurality of sealing lips 55.

At its top end, the insert 4' has a skirt 60 against which the sealing lips 55 come bear in leakproof manner when the applicator 5' is in place in the receptacle 2'.

The skirt 60 is extended downwards by an intermediate portion 61 having a shoulder, said intermediate portion 61 bearing against the inside surface of the body 3' of the receptacle 2' and also against the top end edge thereof.

The intermediate portion 61 is extended downwards by a first wall 62 which extends parallel to the body 3', with the membrane 16' being clamped between said wall 62 of the body 3', and is also extended downwards by a second wall 63.

This second wall 63 tilts towards the inside of the receptacle and constitutes guide means enabling the applicator to be held at a sufficient distance from the axial ends 23' of the slot 17' to ensure that the edges of the slots 17' in the vicinity of said axial ends 23' remain substantially touching while the applicator element is passing through the slot.

At rest, the membrane 16' is in contact with the bottom edge of the second wall 63, which wall constitutes an abutment limiting deformation of the membrane 16' while the applicator 5' is being withdrawn.

In the embodiment shown in FIGS. 14 to 16, the applicator element 6' is constituted by a comb having a plurality of teeth 70 extending substantially on the axis of the applicator, the teeth 70 which are situated in the middle region of the comb being practically parallel to the axis of the applicator, while the teeth which are situated at the ends of the comb make an angle of about 25° with the axis of the applicator.

The bases of the teeth 70 lie on a circular arc that is downwardly convex.

In addition, as can be seen in FIGS. 15 and 16, the teeth 70 of the comb extend substantially parallel to a plane forming an angle of a few degrees with the midplane of the receptacle 2', perpendicularly to the section plane of FIG. 15.

The applicator 5' is not used edge-on, but can be used face-on, i.e. by causing the applicator element 6' to move parallel to the plane of FIG. 15, e.g. in rotary motion as represented by the double-headed arrow in FIG. 16.

By means of the invention, when the applicator element 6' is withdrawn from the receptacle 2', the free ends of the teeth 70 can be wiped appropriately over the entire length of the applicator element 6'.

In addition, the membrane 16' makes it possible to avoid having excess substance present between the teeth 70, and in particular at the ends of the comb.

Naturally, various modifications can be made to the devices described above without thereby going beyond the ambit of the present invention.

The guide member can thus be made in the form of a separate part fitted in the opening of the receptacle, e.g. presenting a conical guide surface designed to facilitate insertion of the application into the receptacle and to enable the applicator to be tilted relative to the axis of the receptacle so as to fill the applicator element with substance contained in the corners of the receptacle.

Figure 13:
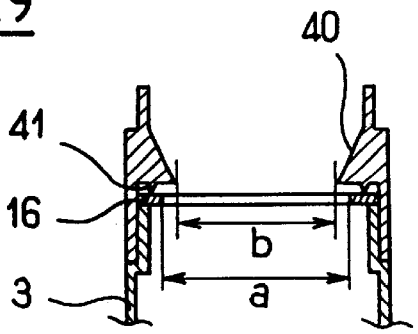
FIG. 13 shows a variant embodiment of the receptacle.

As shown in FIG. 13, the neck of the receptacle can also be made with an outwardly-diverging insertion cone 40 whose smallest longitudinal dimension b is shorter than the length a of the slot so as to hold the applicator element away from the axial end of the slot.

In the embodiment shown in this figure, the membrane 16 is fixed on the receptacle by being clamped between the body 3 of the receptacle and a rib 41 of the cover.

The wiper member may be flocked, and more generally it should be selected as a function of the nature of the substance contained in the receptacle and as a function of the type of wiping that is to be performed.

The applicator is not limited to that described above and it is possible to use other types of applicator, in particular curved applicators of concave or convex shape, of rectilinear shape, or of slanting shape.

The application and the receptacle can co-operate in numerous ways for the purpose of ensuring that the applicator element is held away from the axial ends of the slot.

What is claimed is:

1. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn.

2. A device according to claim 1, wherein the wiper member is organized in such a manner that the slot opens more easily when the applicator is inserted into the receptacle than when it is withdrawn therefrom.

3. A device according to claim 1, wherein the receptacle has an axis and wherein the guide member is constituted by a neck of the receptacle, the axial ends of the slot being situated outside the smallest inside section of the neck when the device is observed on the axis of the receptacle.

4. A device according to claim 3, wherein the receptacle has an axis and wherein the neck is conical so as to enable the applicator to be tilted relative to the axis of the receptacle.

5. A device according to claim 1, wherein the applicator has a flat rod provided at one end with the applicator element.

6. A device according to claim 5, wherein the receptacle has a neck and wherein said guide member is organized in such a manner that the sides of the rod are prevented from coming into contact with the axial ends of the slot.

7. A device according to claim 5, wherein the receptacle has a neck and wherein said neck has an oblong inside section whose smallest longitudinal dimension is only slightly longer than the width of the flat rod.

8. A device according to claim 1, wherein the slot has a length and a long transverse dimension and wherein the length of the slot is greater than or equal to 1.2 times the long traverse dimension of the applicator element.

9. A device according to claim 1, wherein the wiper member comprises a membrane of elastomer material.

10. A device according to claim 9, wherein said membrane has at least one zone of weakness facilitating opening of the slot when the applicator passes through.

11. A device according to claim 10, wherein the zone of weakness is made by means of at least one zone of smaller thickness.

12. A device according to claim 9, wherein the slot has longitudinal edges and wherein the slot is extended at its axial end by cutouts for providing greater mobility to the longitudinal edges of the slot.

13. A device according to claim 12, wherein the slot has longitudinal edges and wherein the cutouts form an angle with the longitudinal edges of the slot.

14. A device according to claim 9, wherein the slot has longitudinal edges and wherein the membrane is fixed on a wall of the receptacle in such a manner that the longitudinal edges of the slot can pivot towards the inside of the receptacle away from said wall during return of the applicator, and come to press against said wall when the applicator is withdrawn.

15. A device according to claim 1, wherein the applicator element is substantially flat, at least when passing through the wiper member.

16. A device according to claim 15, wherein the applicator element is constituted by a brush, a foam, a flock-covered body, or a comb.

17. A device according to claim 1, wherein the applicator has an axis and wherein the applicator element has hairs or teeth extending substantially parallel to the axis of the applicator.

18. A device according to claim 17, wherein the applicator element has an axis and is constituted by a comb having teeth oriented substantially parallel to the axis of the applicator.

19. A device according to claim 18, wherein the bases of the teeth are disposed along a line that is outwardly convex.

20. A device according to claim 1, wherein the receptacle has a body and a cover designed to be fixed to the body, the cover carrying the guide member and the wiper member.

21. A device according to claim 1, wherein the wiper member is fixed on the guide member.

22. A device according to claim 1, wherein the wiper member closes the receptacle in leakproof manner when the applicator is removed therefrom.

23. A device according to claim 1, wherein the wiper member bears in substantially leakproof manner against the applicator when it is in place inside the receptacle.

24. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the receptacle has a body, wherein the applicator has an axis and wherein the wiper member has a resilient membrane clamped between a wall of the body of the receptacle parallel to the axis of the applicator, and an insert fixed on the body of the receptacle.

25. A device according to claim 24, wherein the insert has at its top portion a skirt designed to co-operate in leak proof manner with the applicator when it is in place in the receptacle, and at its bottom portion, a guide portion that converges towards the inside of the receptacle.

26. A device according to claim 24, wherein the guide portion is constituted by a sloping wall whose top end connects to a wall of the insert against which said membrane is clamped.

27. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the wiper member comprises a membrane of elastomer material, wherein said membrane has at least one zone of weakness facilitating opening of the slot when the applicator passes through, wherein the zone of weakness is made by means of at least one zone of smaller thickness.

28. A device according to claim 27, wherein at least one groove surrounds a slot.

29. A device according to claim 27, wherein the zone of weakness is made by means of at least one zone in the form of one or more grooves formed in one of the following: the inside face of said membrane, the outside face of said membrane, or the inside and the outside face of said membrane.

30. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest over their entire length in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the receptacle is closed by the applicator.

31. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the guide member is organized to hold the applicator element far enough away from the axial ends of said slot to ensure that the edges thereof in the vicinity of said axial ends remain substantially touching as the applicator element passes through.

32. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the rod of the applicator is provided at its other end with a handle element which also constitutes a cap for closing the receptacle.

33. A device for packaging and applying a substance, the device comprising a receptacle for containing said substance, an applicator having an axis and an applicator element of elongate cross-section, and a wiper member for wiping the applicator element when the applicator is extracted from the receptacle, wherein the wiper member has a slot having axial ends and whose edges are substantially touching at rest in the absence of the applicator, and wherein the device further comprises a guide member for guiding the applicator while it is being extracted from the receptacle and for keeping the applicator element away from the axial ends of said slot while it passes through the wiper member as the applicator is being withdrawn, wherein the applicator has an axis and wherein the applicator element has hairs or teeth extending substantially parallel the axis of the applicator.

34. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends and whose edges are substantially touching at rest in the absence of the applicator, wherein the receptacle has a body, wherein the applicator has an axis and wherein the wiper member has a resilient membrane clamped between a wall of the body of the receptacle parallel to the axis of the applicator, and an insert fixed on the body of the receptacle.

35. A device for packaging and applying a substance, the device comprising a receptacle for containing said substance, an applicator having an applicator element of elongate cross-section, and a membrane for wiping the applicator element when the applicator is extracted from the receptacle, wherein the membrane has a slot having axial ends and whose edges are substantially touching at rest in the absence of the applicator, and wherein the device further comprises an opening having walls for guiding the applicator while it is being extracted from the receptacle and for keeping the applicator element away from the axial ends of said slot while it passes through the membrane as the applicator is being withdrawn.

36. A device for packaging and applying a substance, the device comprising a receptacle for containing said substance, an applicator having an applicator element of elongate cross- section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn.

37. A device according to claim 36, wherein the wiper member is organized in such a manner that the slot opens more easily when the applicator is inserted into the receptacle than when it is withdrawn therefrom.

38. A device according to claim 36, wherein the receptacle has an axis and wherein the guide member is constituted by a neck of the receptacle, the axial ends of the slot being situated outside the smallest inside section of the neck when the device is observed on the axis of the receptacle.

39. A device according to claim 38, wherein the receptacle has an axis and wherein the neck is conical so as to enable the applicator to be tilted relative to the axis of the receptacle.

40. A device according to claim 36, wherein the applicator has a flat rod provided at one end with the applicator element.

41. A device according to claim 40, wherein the receptacle has a neck and wherein said guide member is organized in such a manner that the sides of the rod are prevented from coming into contact with the axial ends of the slot.

42. A device according to claim 40, wherein the receptacle has a neck and wherein said neck has an oblong inside section whose smallest longitudinal dimension is only slightly longer than the width of the flat rod.

43. A device according to claim 36, wherein the slot has a length and a long transverse dimension and wherein the length of the slot is greater than or equal to 1.2 times the long traverse dimension of the applicator element.

44. A device according to claim 36, wherein the wiper member comprises a membrane of elastomer material.

45. A device according to claim 44, wherein said membrane has at least one zone of weakness facilitating opening of the slot when the applicator passes through.

46. A device according to claim 45, wherein the zone of weakness is made by means of at least one zone of smaller thickness.

47. A device according to claim 44, wherein the slot has longitudinal edges and wherein the slot is extended at its axial end by cutouts for providing greater mobility to the longitudinal edges of the slot.

48. A device according to claim 47, wherein the slot has longitudinal edges and wherein the cutouts form an angle with the longitudinal edges of the slot.

49. A device according to claim 44, wherein the slot has longitudinal edges and wherein the membrane is fixed on a wall of the receptacle in such a manner that the longitudinal edges of the slot can pivot towards the inside of the receptacle away from said wall during return of the applicator, and come to press against said wall when the applicator is withdrawn.

50. A device according to claim 36, wherein the wiper member is fixed on the guide member.

51. A device according to claim 50, wherein the applicator element is constituted by a brush, a foam, a flock-covered body, or a comb.

52. A device according to claim 36, wherein the applicator has an axis and wherein the applicator element has hairs or teeth extending substantially parallel to the axis of the applicator.

53. A device according to claim 52, wherein the applicator element has an axis and is constituted by a comb having teeth oriented substantially parallel to the axis of the applicator.

54. A device according to claim 53, wherein the bases of the teeth are disposed along a line that is outwardly convex.

55. A device according to claim 36, wherein the receptacle has a body and a cover designed to be fixed to the body, the cover carrying the guide member and the wiper member.

56. A device according to claim 36, wherein the wiper member is fixed on the guide member.

57. A device according to claim 36, wherein the wiper member closes the receptacle in leakproof manner when the applicator is removed therefrom.

58. A device according to claim 36, wherein the wiper member bears in substantially leakproof manner against the applicator when it is in place inside the receptacle.

59. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn, wherein the receptacle has a body, wherein the applicator has an axis and wherein the wiper member has a resilient membrane clamped between a wall of the body of the receptacle parallel to the axis of the applicator, and an insert fixed on the body of the receptacle.

60. A device according to claim 59, wherein the insert has at its top portion a skirt designed to co-operate in leak proof manner with the applicator when it is in place in the receptacle, and at its bottom portion, a guide portion that converges toward the inside of the receptacle.

61. A device according to claim 59, wherein the guide portion is constituted by a sloping wall whose top end connects to a wall of the insert against which said membrane is clamped.

62. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn, wherein the wiper member comprises a membrane of elastomer material, wherein said membrane has at least one zone of weakness facilitating opening of the slot when the applicator passes through, wherein the zone of weakness is made by means of at least one zone of smaller thickness.

63. A device according to claim 62, wherein at least one groove surrounds a slot.

64. A device according to claim 62, wherein the zone of weakness is made by means of at least one zone in the form of one or more grooves formed in one of the following: the inside face of said membrane, the outside face of said membrane, or the inside and the outside face of said membrane.

65. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn, wherein the receptacle is closed by the applicator.

66. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member of the applicator is being withdrawn, wherein the guide member is organized to hole the applicator element far enough away from the axial ends of said slot to ensure that the edges thereof in the vicinity of said axial ends remain substantially touching as the applicator element passes through.

67. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn, wherein the rod of the applicator is provided at its other end with a handle element which also constitutes a cap for closing the receptacle.

68. A device for packaging and applying a substance, the device comprising a receptacle for containing said substance, an applicator having an axis and an applicator element of elongate cross-section, and a wiper member for wiping the applicator element when the applicator is extracted from the receptacle, wherein the wiper member has a slot having axial ends, and wherein the device further comprises a guide member for guiding the applicator while it is being extracted from the receptacle and for keeping the applicator element away from the axial ends of said slot while it passes through the wiper member as the applicator is being withdrawn, wherein the applicator has an axis and wherein the applicator element has hairs or teeth extending substantially parallel the axis of the applicator.

69. A device for packaging and applying a substance, the device comprising a receptacle for containing said substance, an applicator having an applicator element of elongate cross-section, and a wiper member for wiping the applicator element when the applicator is extracted from the receptacle, wherein the wiper member has a slot having axial ends, wherein the receptacle has a body, wherein the applicator has an axis and wherein the wiper member has a resilient membrane clamped between a wall of the body of the receptacle parallel to the axis of the applicator, and an insert fixed on the body of the receptacle.

70. A device for packaging and applying a substance, the device comprising a receptacle for containing said substance, an applicator having an applicator element of elongate cross-section, and a membrane for wiping the applicator element when the applicator is extracted from the receptacle, wherein the membrane has a slot having axial ends, and wherein the device further comprises an opening having walls for guiding the applicator while it is being extracted from the receptacle and for keeping the applicator element away from the axial ends of said slot while it passes through the membrane as the applicator is being withdrawn.

* * * * *